US010323858B2

(12) United States Patent
Bowers et al.

(10) Patent No.: US 10,323,858 B2
(45) **Date of Patent: *Jun. 18, 2019**

(54) LIQUID HEATER WITH TEMPERATURE CONTROL

(71) Applicant: Heatworks Technologies, Inc., Sullivan's Island, SC (US)

(72) Inventors: John H. Bowers, Clarksburg, NJ (US); Gregory S. Lyon, Mamaroneck, NY (US)

(73) Assignee: Heatworks Technologies, Inc., Sullivans Island, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/412,181

(22) Filed: Jan. 23, 2017

(65) Prior Publication Data

US 2017/0159968 A1 Jun. 8, 2017

Related U.S. Application Data

(60) Continuation of application No. 14/327,941, filed on Jul. 10, 2014, now Pat. No. 9,587,853, which is a (Continued)

(51) Int. Cl.
*H05B 3/60* (2006.01)
*F24H 1/10* (2006.01)
(Continued)

(52) U.S. Cl.
CPC ..... *F24H 1/106* (2013.01); *F24H 9/18* (2013.01); *F24H 9/1809* (2013.01); *F24H 9/2028* (2013.01)

(58) Field of Classification Search
CPC . F24H 1/106; F24H 1/10; F24H 1/105; F24H 1/102; F24H 9/16; F24H 9/18; F24H 9/2028; F24H 9/1809; F24H 9/1818
(Continued)

(56) References Cited

U.S. PATENT DOCUMENTS 4,418,269 A 11/1983 Eaton-Williams
4,547,079 A 10/1985 Alamprese et al.
(Continued)

FOREIGN PATENT DOCUMENTS

CA 1291785 C 11/1991
EP 0349689 A1 1/1990
(Continued)

OTHER PUBLICATIONS

International Search Report and Written Opinion dated Nov. 6, 2012, in International Appl. No. PCT/US2011/050967.
(Continued)

*Primary Examiner* — Michael G Hoang
(74) *Attorney, Agent, or Firm* — Lerner, David, Littenberg, Krumholz & Mentlik, LLP

(57) ABSTRACT

A liquid heater such as a direct electrical resistance liquid heater having multiple flow channels is provided with a temperature-sensing element in the form of a wire extending across numerous channels, preferably all of the channels, near the downstream ends of the channels. The resistance of the wire represents the average temperature of the liquid passing through all of the channels, and hence the temperature of the mixed liquid exiting from the heater. A bubble suppressing structure is provided in the vicinity of the wire.

18 Claims, 2 Drawing Sheets

Related U.S. Application Data division of application No. 12/889,581, filed on Sep. 24, 2010, now Pat. No. 8,861,943, which is a continuation-in-part of application No. 11/352,184, filed on Feb. 10, 2006, now Pat. No. 7,817,906.

(60) Provisional application No. 60/726,473, filed on Oct. 13, 2005, provisional application No. 60/709,528, filed on Aug. 19, 2005, provisional application No. 60/677,552, filed on May 4, 2005.

(51) Int. Cl.
*F24H 9/20* (2006.01)
*F24H 9/18* (2006.01)

(58) Field of Classification Search
USPC ..... 392/311, 314, 316, 318, 319, 320, 322, 392/331, 441, 465, 486, 315, 323; 219/385, 388, 438, 548
See application file for complete search history.

(56) References Cited

U.S. PATENT DOCUMENTS

| | | | |
|---|---|---|---|
| 4,900,896 | A | 2/1990 | Maus |
| 5,091,612 | A | 2/1992 | Van Fossen |
| 5,167,153 | A | 12/1992 | McQueen |
| 5,216,743 | A | 6/1993 | Seitz |
| 5,325,822 | A | 7/1994 | Fernandez |
| 5,408,578 | A | 4/1995 | Bolivar |
| 5,479,558 | A | 12/1995 | White, Jr. et al. |
| 5,866,880 | A | 2/1999 | Seitz et al. |
| 6,080,971 | A | 6/2000 | Seitz et al. |
| 6,080,973 | A | 6/2000 | Thweatt, Jr. |
| 6,130,990 | A | 10/2000 | Herrick et al. |
| 6,246,831 | B1 | 6/2001 | Seitz et al. |
| 6,389,226 | B1 | 5/2002 | Neale et al. |
| 6,522,834 | B1 | 2/2003 | Herrick et al. |
| 6,552,283 | B2 | 4/2003 | Cabrera et al. |
| 6,640,048 | B2 | 10/2003 | Novotny et al. |
| 6,701,069 | B1 | 3/2004 | Cezayirli et al. |
| 6,834,160 | B1 | 12/2004 | Chen-Lung et al. |
| 6,849,178 | B2 | 2/2005 | Hecking |
| 7,050,706 | B2 | 5/2006 | Israelsohn et al. |
| 7,164,851 | B2 | 1/2007 | Sturm et al. |
| 7,190,886 | B2 | 3/2007 | Dubicki et al. |
| 7,403,701 | B2 | 7/2008 | Choi et al. |
| 7,742,689 | B2 | 6/2010 | Harrison et al. |
| 7,779,790 | B2 | 8/2010 | Fabrizio |
| 7,817,906 | B2 * | 10/2010 | Callahan ..... F24H 1/106 392/311 |
| 7,903,956 | B2 | 3/2011 | Colburn et al. |
| 8,532,474 | B2 | 9/2013 | Campbell |
| 8,565,588 | B2 | 10/2013 | Bierbaumer et al. |
| 8,649,670 | B2 | 2/2014 | Lu et al. |
| 8,861,943 | B2 | 10/2014 | Bowers et al. |
| 9,423,151 | B2 | 8/2016 | Kacar et al. |
| 2006/0291527 | A1 | 12/2006 | Callahan et al. |
| 2009/0317068 | A1 | 12/2009 | Yeung |
| 2010/0086289 | A1 | 4/2010 | Johnson et al. |
| 2010/0322605 | A1 | 12/2010 | van Aken et al. |

FOREIGN PATENT DOCUMENTS

| | | | |
|---|---|---|---|
| WO | 2005020175 | A1 | 3/2005 |
| WO | 2005066551 | A1 | 7/2005 |
| WO | 2009100486 | A1 | 8/2009 |
| WO | 2009111640 | A2 | 9/2009 |
| WO | 2012092641 | A1 | 7/2012 |

OTHER PUBLICATIONS

Official Action No. 3080 dated in or around Apr. 2014 in Columbian Patent Application No. 13-092042, entitled "Liquid Heater With Temperature Control." (English language translation only).
Partial ISR dated Sep. 3, 2012 for PCT/US2011/050967.
International Search Report and Written Opinion for PCT/US2017/060192 dated Feb. 26, 2018.

* cited by examiner

LIQUID HEATER WITH TEMPERATURE CONTROL

CROSS-REFERENCE TO RELATED APPLICATIONS

The present application is a continuation of U.S. patent application Ser. No. 14/327,941, filed Jul. 10, 2014, which application is a divisional of U.S. patent application Ser. No. 12/889,581, filed on Sep. 24, 2010, which application is a continuation-in-part of U.S. patent application Ser. No. 11/352,184, filed on Feb. 10, 2006 and published as US Patent Application Publication No. US 2006/0291527 A1, now U.S. Pat. No. 7,817,906, which application claims benefit of the filing date of U.S. Provisional Patent Application Nos. 60/677,552, filed on May 4, 2005; 60/709,528, filed on Aug. 19, 2005; and 60/726,473, filed on Oct. 13, 2005. The disclosures of all of the aforementioned applications and publication are incorporated herein by reference.

FIELD OF THE INVENTION

The present invention relates to liquid heaters, and components thereof.

BACKGROUND OF THE INVENTION

As set forth in the aforementioned US Patent Application Publication No. US 2006/0291527 A1 ("'527 Publication"), it is advantageous to heat fluids, particularly liquids such as water for use as domestic hot water using a "tankless" heating device. A tankless heating device is intended to heat the fluid as it flows from a source to a point of use. A tankless heater does not rely on a stored reservoir of preheated liquid, but instead is designed with sufficient capacity to heat the liquid to the desired temperature, even as the liquid flows through the heater at a rate equal to the maximum expected demand. For example, if a tankless heater is intended to provide hot water to shower in a home, the heater is designed with sufficient capacity to heat water at the lowest expected incoming temperature to the highest desired shower temperature at the maximum flow rate of the shower.

As disclosed in the '527 Publication, one form of fluid heater particularly suitable for liquids such as domestic water heating is a direct electric resistance liquid heater. In a direct electric resistance liquid heater, electrical power is applied between electrodes immersed in the liquid to be heated so that current flows through the liquid itself and power is converted into heat due to the electrical resistance of the liquid itself. As also disclosed in the '527 Publication, such a heater can be arranged with multiple electrodes defining numerous channels for liquid flow. The control system for such a heater may be arranged to connect and disconnect different ones of the electrodes to a power supply. The electrodes and associated elements of the heater can be arranged so that connection of different sets of the electrodes to the electrical power supply connection provides different levels of current passing through the liquid. These levels most preferably include a step-wise progression between zero current when none of the electrodes are connected and a maximum current when all of the electrodes are connected. As disclosed in the '527 Publication, this progression desirably has substantially uniform ratios between the currents of adjacent steps of the progression having non-zero current levels. As explained in the '527 Publication, heaters having such a set of possible current levels can provide progressive control of liquid temperature despite wide variations in incoming liquid temperature, desired outgoing liquid temperature, flow rate, and resistivity of the liquid. The desired step-wise progression desirably includes numerous steps as, for example, 60 or more steps or different current levels for fluid of a given resistivity. Most preferably, the steps are arranged so that the maximum ratio between the current levels in any two adjacent steps of the progression having non-zero currents is no more than about 1.22:1, and preferably no more than about 1.1:1, and so that the greatest difference between levels of current in any two adjacent steps of the progression is no greater than about 10% of the maximum current for the given level of fluid resistivity.

Because the heat is evolved within the liquid itself, such a heater can provide essentially instantaneous heating of the liquid flowing through it. Moreover, the heater can be controlled by simply connecting and disconnecting different ones of the electrodes to the power supply, allowing use of switching elements such as conventional relays or, more preferably, solid-state semiconductor switching elements such as triacs and field effect transistors. The preferred semiconductor switching elements can be brought to a conducting or "closed" state in which they have very low electrical resistance, or a substantially non-conducting state in which they have extremely high, almost infinite resistance and conduct essentially no current, and thus act as an open switch. Thus, the semiconductor elements themselves dissipate very little power, even though substantial electrical currents flow through them when they are in their closed states.

The heater disclosed in the '527 Publication includes a temperature sensor arranged to sense the temperature of the heated liquid near a controller responsive to the signal from the temperature sensor for controlling the switching elements, and thereby controlling the power applied by the heater to the flowing liquid. The preferred temperature sensor taught in the '527 Publication includes a "thermally conductive temperature sensing plate" which is "placed as close as practicable to the end of the heating chamber and perpendicular to the flow of liquids such that the liquid leaving the heating chamber must pass through the perforations of the temperature sensing plate," and also includes a "semiconductor junction based temperature sensor" mounted to the plate. As set forth in the '527 Publication, however, such an arrangement suffers from "thermal lag or delay" between changes in temperature of the heated liquid and the signal output from the thermal sensor because of the thermal resistance of the thermal plate and packaging of the thermal sensor and the "thermal mass" of these components. To compensate for this, the control system includes a signal conditioner circuit which creates a signal which represents "the rate of change of the temperature as measured by the temperature sensor," and this signal is summed with the signal representing the temperature itself. While this arrangement provides satisfactory operation, further improvement would be desirable.

BRIEF SUMMARY OF THE INVENTION

One aspect of the invention provides a fluid heater including a channel structure defining a plurality of channels extending in a downstream direction so that fluid can flow in parallel downstream though the channels from the inlet to the outlet. The channel structure preferably includes one or more electrical energy application elements associated with each channel. For example, the energy application elements may be electrodes as discussed in the '527 Publication. The heater desirably also includes a temperature-sensing wire extending across the plurality of channels adjacent the downstream ends thereof; and a control circuit connected to the energy application elements and the wire, the control circuit being arranged to monitor an electrical resistance of the wire and control application of power to the application elements responsive to the electrical resistance of the wire. The control circuit desirably is arranged so that in at least some control conditions, fluid flowing through different ones of the channels will be heated to different temperatures. As further discussed below, the electrical resistance of the wire represents an aggregate or average of the sections associated with the various channels, and thus represents the final temperature of the fluid which will result when the fluid passing from the channels mixes as it passes downstream from the channels.

A further aspect of the invention provides a fluid handling device which can be used, for example, in a heater as discussed above. The heater according to this aspect of the invention desirably includes a channel structure defining at least one channel extending in a downstream direction and an elongated wire extending across the channel in a widthwise direction adjacent a downstream end of the channel. The device further includes an exit structure bounding the channel at a downstream end of the channel. The exit structure most preferably defines a slot extending across the channel in the widthwise direction in alignment with the wire. The slot desirably has a cross-sectional area smaller than the cross-sectional area of the channel and desirably is open for flow of fluid exiting from the channel. The exit structure preferably also defines a pair of collection chambers disposed on opposite sides of the slot and offset from the slot in lateral directions transverse to the downstream direction and widthwise direction, and a pair of elongated lips extending in the widthwise direction and separating the chambers from the slot, the collection chambers being open in the upstream direction and extending downstream from the lips. The exit structure desirably further defining exit bores communicating with the collection chambers and open for flow of fluid exiting from the channel. Preferably, the exit bores collectively have cross-sectional area smaller than the cross-sectional area of the slot. The exit structure helps to prevent attachment of bubbles to the wire. Where the wire is a temperature-sensing wire as discussed above, this improves the sensing action.

DETAILED DESCRIPTION

Figure 1:
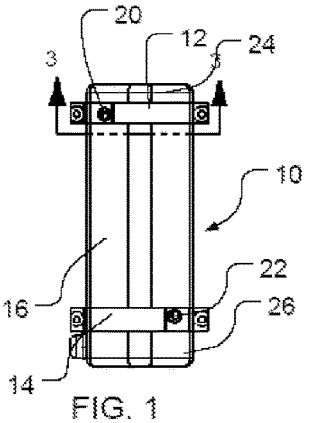
FIG. 1 is an exterior plan view of a heater according to one embodiment of the invention.

A heater according to one embodiment of the invention includes a housing 10 (FIG. 1). The housing 10 includes a first end cap 12, second end cap 14, and a generally tubular enclosure 16 extending between these end caps. The first and second end caps are provided with mounting feet 18. The first and second end caps desirably are formed from a metallic material as, for example, a die cast or machined metal. Enclosure 16 desirably has substantially constant cross-section along its length between the end caps and desirably is formed from a metallic material. For example, enclosure 16 may be formed from an extruded metal such as extruded aluminum. Enclosure 16 is removed in FIG. 2 for clarity. Enclosure 16 and caps 12 and 14 cooperatively define a pressure-tight vessel. The first end cap 12 is provided with a fluid inlet port 20, whereas the second end cap 14 has a fluid outlet port 22. A shroud 24 covers the first end cap 20, whereas a further shroud 26 covers the second end cap 14. As explained below, the second shroud 26 encloses certain electrical components. Shroud 26 and the associated electrical components are removed in FIG. 2 for clarity of illustration.

A dielectric structure 30 is mounted within enclosure 16. The dielectric structure 30 desirably includes numerous intermediate sections 32 identical to one another, the intermediate sections 32 being stacked one upon the other along the lengthwise direction of enclosure 16. The stacked intermediate sections define slots 49. The dielectric structure also includes a first interior end piece 34 mounted within first end cap 12 and a second interior end piece 36 mounted within second end cap 14. Portions of these pieces are removed in FIG. 2 for clarity of illustration. Dielectric structure 30 defines a fluid intake channel 38 extending lengthwise within enclosure 16, a fluid outlet channel 40 extending lengthwise within housing 10, a fluid outlet channel 40 also extending lengthwise within the housing and within enclosure 16, and a pair of heating chambers 42 and 44 (FIG. 3) also extending lengthwise within housing 10 and enclosure 16. Chamber 42 is referred to herein as the "upper" heating chamber, whereas chamber 44 is referred to herein as the "lower" heating chamber, but such designation does not imply any particular orientation relative to the gravitational frame of reference.

Figure 3:
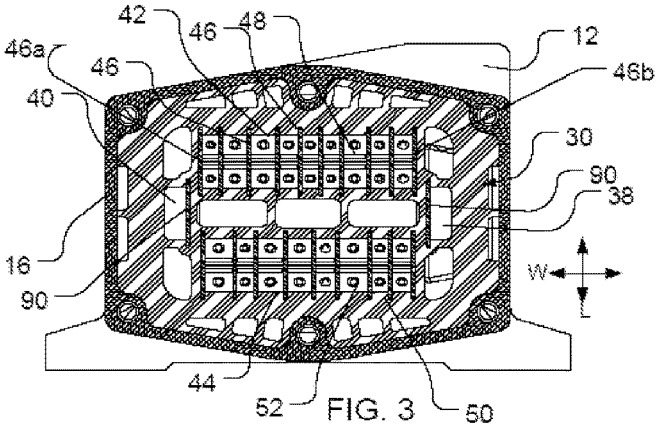
FIG. 3 is a sectional view along line 3-3 in FIG. 1.
Figure 5:
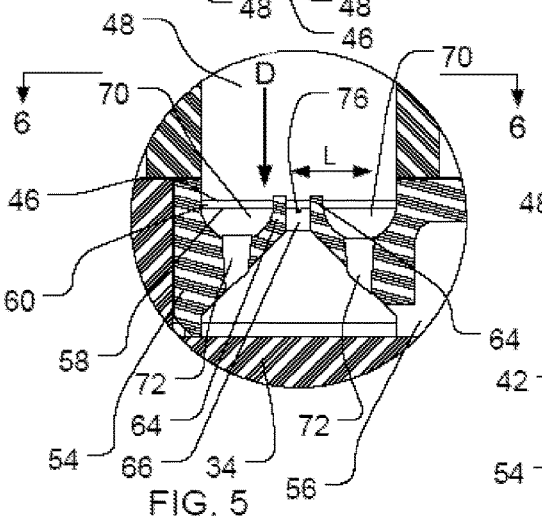
FIG. 5 is a fragmentary sectional view depicting the area indicated at 5 in FIG. 4.

As best seen in FIGS. 3 and 5, numerous flat, plate-like electrodes 46 are mounted to the polymeric structure 30 and subdivide upper heating chamber 42 into 10 individual, generally rectangular channels 48. Two of the electrodes 46 are mounted at the edges of the chamber, and bound the channels nearest the edges. As further discussed below, the spacing between electrodes 46 are not uniform, so that different channels 48 have different widths. Lower heating chamber 44 contains further flat, plate-like electrodes 50 subdividing chamber 44 into numerous generally rectangular individual channels 52 (FIG. 3) which also have differing widths.

Figure 6:
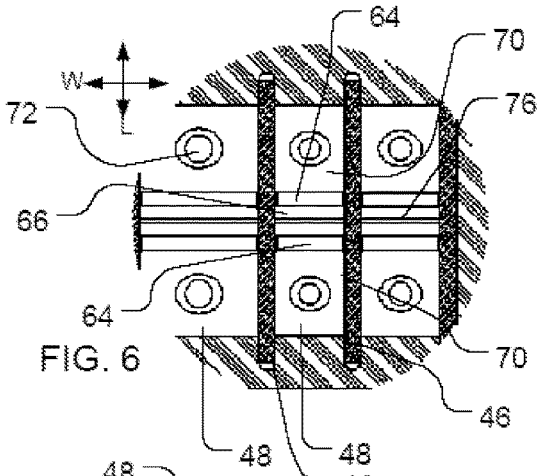
FIG. 6 is a further sectional view along line 6-6 in FIG. 5.
Figure 4:
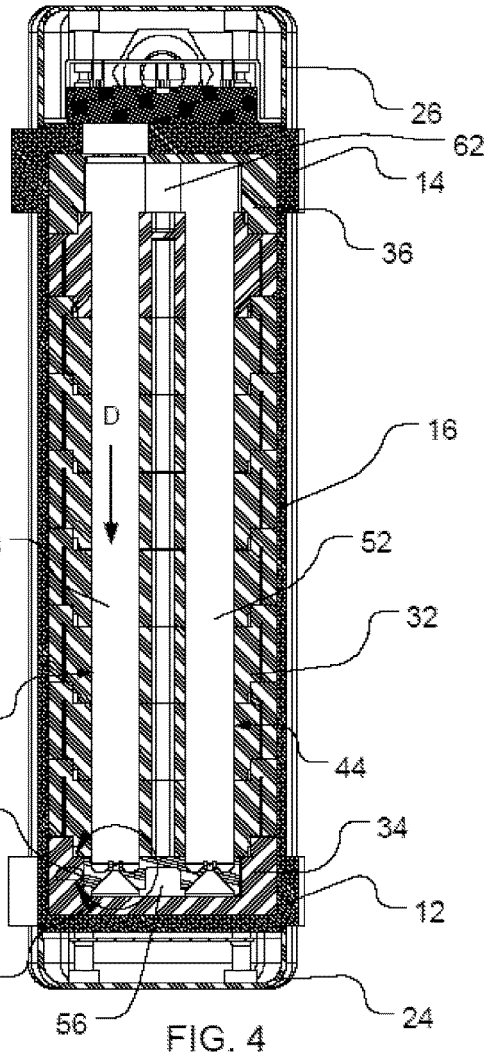
FIG. 4 is a sectional view of the heater depicted in FIG. 1.

As best seen in FIGS. 4, 5, and 6, an exit structure 54 bounds chambers 42 and 44 and hence channels 48 and 52 at downstream ends of the channels 48 and 52 near the first end plate 12 and first interior end piece 34. The exit structure 54 thus separates the channels and heating chambers from an exit chamber 56 (FIGS. 4 and 5) within first interior end piece 34.

As best seen in FIG. 5, exit wall structure 54 has an upstream side (toward the top of the drawing in FIG. 5) facing toward the channels 48 and a downstream side (toward the bottom of the drawing in FIG. 5) facing towards exit space 56. The electrodes 46 are received in grooves (not shown) extending into the upstream side of the exit structure 54. The exit structure 54 also has dividing walls 58 which are substantially coplanar with the individual electrodes so that the dividing walls 58 effectively maintain each channel 46 separate from the adjacent channel 46. There is a small gap 60 between each electrode and the coplanar dividing wall 58, but such gaps are substantially inconsequential with respect to fluid flow. The end of each channel 48 at exit structure 54 is effectively closed by the exit structure apart from the openings in the exit structure discussed below.

The second interior element 36 at second end gap 14 defines a fluid inlet space, schematically shown at 62 (FIGS. 2 and 4), open to the ends of the channels adjacent the second end gap 14. Fluid intake passage 38 communicates with the fluid inlet port 20 in the first end cap 12, and with the fluid inlet space 62 (FIGS. 2 and 3) adjacent the second end cap 14. Fluid outlet channel 40 (FIGS. 2 and 3) communicates with the exit space 56 (FIGS. 4 and 5) adjacent the first end cap 12, and also communicates with the fluid outlet port 22 of second end cap 14 (FIG. 1). Thus, as indicated by the curved flow path 63 shown in FIG. 2, fluid passing through the device enters first end cap 12 and passes through fluid inlet channel 38 to inlet chamber 62 adjacent the second end cap 14. The fluid then passes through channels 48 and 52 of the flow chambers 42 and 44 toward the first end cap 12, and passes from the channels through the openings in exit structure 54 into exit chamber 56. The fluid then passes from exit chamber 56 through fluid outlet channel 40 (FIGS. 2 and 3) and out of the device through outlet port 22 in the second end cap 14. Thus, the fluid flowing within channels 48 and 52 passes in the direction from second end cap 14 toward first end cap 12. In referring to the structures of the channels and the exit structure, that direction is referred to herein as the "downstream direction" and is indicated by arrow D in each of FIGS. 2, 4, and 5, whereas the opposite direction is referred to herein as the "upstream" direction.

As best seen in FIGS. 5 and 6, exit structure 54 includes a pair of lips 64 extending across each channel 48 in directions referred to herein as the "wire" or "widthwise" directions of the channel W (FIG. 6). The widthwise direction is into and out of the plane of the drawing in FIG. 5. The lips 64 define a slot 66 between them. The slot is elongated and extends across the channel 48 in the widthwise direction W. As best seen in FIG. 5, slot 66 is open to the exit space 56, so that the slot is open for flow of fluid exiting from the channel 48.

The exit structure also defines a pair of collection chambers 70 which are offset from the slot 66 in opposite lateral directions symbolized by arrows L in FIGS. 5 and 6. The lateral directions are transverse to the widthwise direction W and also transverse to the downstream direction D. The collection chambers 70 associated with each channel 48 are separated from the slot 66 by the lips 64 and extend downstream from the lips. The collection chambers are open in the upstream direction. The exit structure also defines exit bores 72 connecting the downstream ends of the collection chambers 70 with the exit space 56. Thus, the exit bores are also open for flow of fluid exiting from the channel 48. The slot 66 associated with each channel has a smaller cross-sectional area than the channel. The exit bores 72 associated with each channel also have a smaller cross-sectional area than the channel and, preferably, an aggregate cross-sectional area less than the cross-sectional area of the slot.

As best seen in FIG. 5, each of the collection chambers 70 has a bounding wall which is generally in the form of a semicircle having its axis extending in the widthwise direction W (the direction into and out of the plane of the drawing in FIG. 5). The bounding wall of each collection chamber 70 includes an inner bounding wall extending along the side of one of the lips. Such bounding wall slopes away from the slot in the lateral direction toward the downstream end of the collection chamber. Each collection chamber 70 also has an outer bounding wall remote from the slot and sloping generally inwardly toward the slot toward the downstream end of the collection chamber. The bounding walls slope towards each other and meet at the point of the collection chamber furthest downstream, at the intersection of the chamber and the exit bore 72 associated with the chamber.

The exit structure 54 defines a similar arrangement of a slot collection chambers and exit bores for each channel 48 in the upper flow chamber 42 and for each channel 52 in the lower flow chamber 44.

As best seen in FIG. 6, the slots 66 of all of the flow channels 48 in the upper flow chamber 42 are aligned with one another, as are the exit chambers of all of the channels 48. The slot, lips, and exit chambers occupy substantially the entire cross-sectional area of each channel. The slot associated with each channel is the same width in the lateral direction L, but extends across the entire extent of the channel in the wire direction W. As best appreciated with reference to FIG. 6, and also with reference to FIG. 3, the various channels 46 in the upper flow chamber differ from one another in their dimensions in the wire direction W, and hence in cross-sectional area. Likewise, the various channels 52 in the lower flow chamber 48 differ in wire-direction dimensions, and hence in cross-sectional area from one another. This is a consequence of the unequal spacings between the electrodes 46 and between the electrodes 50 associated with the various flow channels. However, each slot has a cross-sectional area substantially smaller than the associated channel. Merely by way of example, the width of each slot 66 in the lateral direction L may be on the order of 0.115 inches, whereas the dimension of each channel 46 and 52 in the lateral direction may be about 0.929 inches, so that the ratio of slot cross-sectional area to channel cross-sectional area is about 0.12.

The diameters of the exit bores, such as exit bores (FIGS. 5 and 6) desirably are selected so that the exit bores associated with the smallest channel have the minimum diameter which will reliably allow bubbles to pass through the bores. Although the present invention is not limited by any theory of operation, it is believed that this minimum diameter is related to the surface tension of the liquid. For domestic hot water at about 100-120° F., the minimum diameter is about 0.070 inches. This minimum diameter yields a ratio of about 0.35 between the aggregate area of the exit bores and the open area of the slot 66 associated with the smallest channel (after deducting area blocked by the wire 76 discussed below). The exit bores associated with larger channels are of larger diameter so as to maintain a reasonably uniform ratio between the cross-sectional areas of the exit bores associated with each channel and the cross-sectional area of the slot associated with each channel. For example, this ratio can be about 0.3 to about 0.45 for all of the channels.

A unitary elongated wire 76 is mounted to the exit structure and extends in the widthwise direction W in alignment with the slots 66 associated with all of the channels 48 in the upper chamber 42. Wire 76 is supported in small notches in the dividing walls 58 of exit structure 54. Wire 76 extends along the slots of all of the chambers. A portion of the wire (not shown) extends between the slots of the upper flow chamber and the slots associated with the lower flow chamber. This portion is positioned within exit space 56. Wire 76 is a fine diameter wire having resistance which varies with temperature. For example, wire 76 may be a wire formed from a nickel-iron alloy such as a 70% nickel, 30% iron alloy of the type sold under the commercial designation Balco 120 ohm alloy, and may be about 40 gauge (0.079 mm diameter) with a thin dielectric covering. The dielectric covering preferably is formed from a polymer as, for example, a fluoropolymer such as a PTFE polymer sold under the trademark Teflon®. The dielectric covering insulates the wire from the fluid flowing in the heater. The dielectric covering should be as thin as practicable without pinholes or other gaps.

Figure 2:
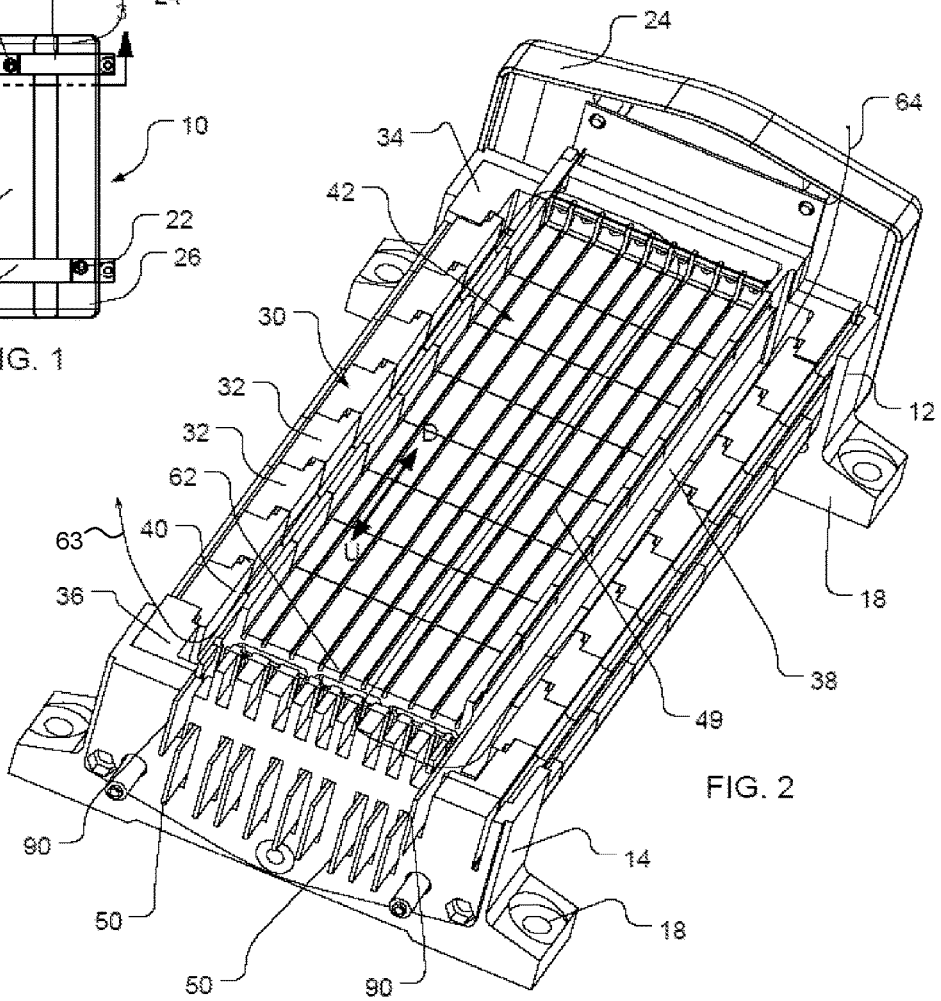
FIG. 2 is a perspective cut-away view of the heater according to FIG. 1 with portions removed for clarity of illustration.

The upstream ends of electrodes 50 and 48 project through the second interior end structure 36 and second end cap 14 as best appreciated with reference to FIG. 2, where the upstream ends of electrodes 50 associated with the lower flow chamber are visible. The electrodes 46 associated with the upper flow chamber 42 are removed in FIG. 2 for clarity of illustration. The electrodes are sealed to the second interior end structure 36. The upstream ends of the electrodes are connected to switching elements mounted within shroud 26 (FIG. 4). A few of the switching elements are schematically indicated by arrows 82 in FIG. 7. The switching elements may be relay-actuated mechanical switches, but most preferably are semiconductor switching elements such as triacs, field effect transistors or the like. The switching elements associated with each electrode desirable are operable to connect each electrode to either pole 84 or 86 of an AC power supply connection. The AC power supply connection in this embodiment is a single-phase AC connection arranged for connection to the ordinary household electrical power supply. When the poles of the power supply are connected to the household current supply, there is an alternating voltage, typically 220 volts in the US, between poles 84 and 86. Although only a few electrodes 46 and 50 are depicted in FIG. 6 for clarity of illustration, each electrode has switching elements 82, and each electrode can be independently connected to either pole of the power supply.

Figure 7:
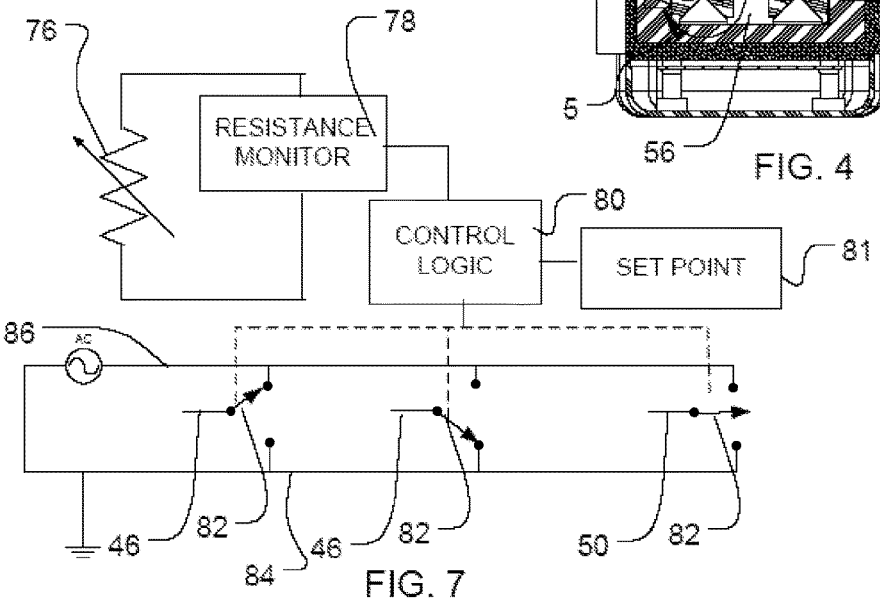
FIG. 7 is a schematic view in block diagram form of an electrical circuit used in the heater of FIGS. 1-6.

Wire 76 is connected in a control circuit schematically shown in FIG. 7. The control circuit includes a resistance monitor 78 arranged to detect the electrical resistance of wire 76 and to supply a signal representing the resistance of wire 76 as a temperature signal representing the temperature of fluid within or passing through the heater. The control circuit further includes a control logic unit 80 which is linked to the resistance monitor so that the control logic receives the temperature signal. The control logic unit is also connected to a source 81 of a set point value. This set point value may be a permanent setting or may be a user selectable setting, in which case the source 81 of the set point may be a user-operable control such as a dial, keypad, or the like.

The switching elements 82 are actuated by the control logic 80. As explained in greater detail in the '527 Publication, control logic 80 can connect the electrodes to the poles of the current supply and can leave some or all of the electrodes unconnected. By connecting and disconnecting the different electrodes to the power supply, the control logic can create current paths of differing lengths and hence differing electrical resistance. Merely by way of example, connecting electrodes 46*a* and 46*b* at the extreme ends of chamber 42 to opposite poles of the current supply while leaving all of the other electrodes 46 disconnected from the power supply creates a relatively long, high resistance current path through the fluid in all of the flow channels 48 of upper chamber 42. By contrast, connecting any two immediately adjacent electrodes to one another creates a very short, low-resistance and hence high-current flow path. The unequal spacings between electrodes allow for creation of a wide variety of flow paths of different lengths. A plurality of current flow paths can be created by connecting more than two electrodes to the poles of the power supply, and each current flow path may include a single flow channel or multiple flow channels. The flow channels of lower chamber 44 provide a similar action. As explained in greater detail in the '527 Publication, the spacings of the electrodes provide current flow paths having differing electrical resistance, and hence differing electrical conductance when filled with fluid of a given conductivity. The conductances and hence the current which will flow along each path desirably include numerous different conductances and currents. The different conductances and currents desirably include conductances and currents defining a step-wise progression of conductances and currents forming a substantially logarithmic progression between a minimum non-zero conductance (and minimum non-zero current flow) and a maximum conductance and maximum current flow. For each step in the progression, the conductance and is the sum of the conductances between all of the pairs of electrodes which are connected to the power supply, and the current flow is the sum of all of the current flows between the connected electrodes. Desirably, the ratios of current flow, and hence conductance, of the steps in the progression are substantially uniform. Most preferably, the progression includes at least 60 steps, and desirably more, and is selected so that the difference in current flow between any two steps of the progression is no greater than about 25% of the maximum current flow and desirably less, more preferably about 10% of the maximum current flow or less. The available conductances and current flow values may also include redundant values not necessary to form the progression as, for example, a current flow value which is exactly the same as or almost exactly the same as another current flow value incorporated in the progression.

As described in greater detail in the '527 Publication, control logic 80 responds to a signal indicating the temperature of the fluid flowing through the heater, or present in the heater, which in this case is the signal from resistance monitor 78, by picking a step having a greater or lesser aggregate current value. Most preferably control logic 80 is arranged to evaluate the signal and change the current value accordingly at numerous times per second, most preferably once on each cycle of the AC voltage applied to the power supply 84, 86. In a particularly preferred arrangement, the control logic is arranged to switch any of the switching elements as required to change the combination of inactive electrodes at about the time the voltage on the power supply crosses zero during the normal AC cycle. This helps to assure that the switching action does not generate electrical "noise" on the power line or radio frequency interference. Moreover, the control logic desirably is arranged to change the set of connected electrodes one step on each cycle. That is, if the temperature signal indicates that a greater current flow is required, the control logic will select the connection which gives the next higher step of the step-wise progression and energize the electrodes in that pattern, and repeat as required until the temperature signal indicates that the temperature of the liquid is at the desired value. Stated another way, the control logic desirably does not "jump" immediately to a much higher step. This helps to assure that the switching action does not cause voltage fluctuations on the supply line, and hence does not cause, for example, dimming of lights in a building where the heater is installed.

Leakage electrodes 90 are mounted in intake passage 38 and outlet passage 40. The leakage electrodes also extend through the second interior end structure 36 and second end cap 14. The leakage electrodes are permanently connected to the ground connection of the power supply. The leakage electrodes assure that current cannot pass from any of the electrodes 46 or 50 through the flowing liquid to the plumbing system or to the fluid flowing through the system. The leakage electrodes also assure that current cannot pass to either of the end caps or to the enclosure 16. The enclosure and end caps also may be electrically connected to the ground connection of the power supply for even further assurance.

In operation, the inlet port 20 is connected to a source of the liquid to be heated, such as the plumbing system of a home, and the outlet port 22 is connected to a point of use. A liquid such as water flows through the heater, as discussed above, through intake channel 38, passing generally in the upstream direction U from the first end cap 12 toward the end cap 14 in the inlet channel and contacting the leakage electrode in such channel. The liquid then passes downstream through the various channels 48 and 50 while being heated by passage of current through the liquid between the electrodes. As the liquid reaches the downstream end of each channel, the major portion of the liquid flowing in each channel passes out of the channel into the exit space 56 (FIGS. 5 and 6) through the slots associated with each channel, and thus passes over the wire 76.

The wire 76 extends along the slots associated with all of the channels, and thus is exposed to the liquid flowing in all of the channels. The liquid flowing in different ones of the channels will be heated by different amounts. For example, if the particular combination of electrodes which are connected to the power supply is such that no current is flowing across a particular channel, the liquid flowing in such channel will not be heated directly at all, although it may be heated slightly heat transfer from adjacent channels. The liquid flowing in the various channels mixes in exit space 56 and passes out of the heater through outlet channel 40, where it again contacts the current leakage electrode 90 and passes out of the system through outlet port 22. The actual temperature of the liquid passing out of the outlet will reflect the temperature of the liquid passing out of the various channels in combination; the hotter and colder liquids will mix to form a liquid having a final average temperature.

Because wire 76 is exposed to the liquid passing out of all of the channels, the resistance of the wire will reflect the final average temperature of the liquid passing out of the heater. However, by measuring the temperature as close as practicable to the downstream end of the individual channels, prior to mixing, the resistance of the wire will measure the final average without the time delay required for the mixing process to occur. Moreover, because the wire 76 has very low thermal mass, its resistance will follow the temperatures of the liquids flowing from the channels almost instantaneously. These factors minimize "loop delay" in the control system. This can best be understood with reference to a hypothetical system in which the average temperature is measured downstream from the heating channels as, for example, at the fluid outlet port 22 of the heater. In such a system, if the temperature of the liquid is less than the desired set point temperature, the control logic will bring the electrodes to a higher current setting and thus apply more heat. However, until the heated liquid passes downstream to the outlet port, the liquid passing over the sensor remains below the set point temperature, and hence the control logic will continually increase the amount of current applied. This may cause the control logic to apply much greater current than is actually required to produce the desired set point, leading to an "overshoot" condition. By minimizing loop delay, the heater according to this embodiment provides a more effective control system. The resistance signal from resistance monitor 78 so closely tracks the temperature that it is normally not necessary to provide a signal representing the change in the resistance signal to the control logic. However, such a signal can be applied if desired.

Wire 76 is disposed very close to the downstream ends of the electrodes and channels. Thus, wire 76 is in effective thermal communication with the fluid contained within the channels themselves, even when no liquid is flowing. Thus, the control system can maintain the temperature of the liquid within the channels at the desired set point, even while no liquid flows through the system. It is not necessary to provide a separate sensor for use during such no-flow conditions. Moreover, it is not necessary to provide a flow sensor or other device to detect the occurrence of a no-flow condition.

All of these benefits are provided with an extremely simple temperature-sensing arrangement. The single wire used in the embodiments discussed above provides the ultimate in simplicity, and requires only one or two connections to the exterior of the pressurized, fluid-filled space.

In a further arrangement, unitary wire 76 may have multiple passes or turns, with each pass or turn extending across all of the slots associated with all of the flow channels. This provides increased sensitivity or change in resistance per unit change in temperature. In yet a further variant, the wire may be provided in sections, with each section extending across only a few of the channels and with the resistance of each section being monitored separately by the control system. In such an arrangement, however, the control system preferably would include a circuit which mathematically combines the resistance values as, for example, by taking an average. In a still further variant, an individual wire or other sensor could be provided for each channel. However, such an arrangement would require a more complex circuit, more complex logic programming in the circuit, or both. Moreover, an arrangement using multiple sensors associated with multiple channels would require multiple electrical connections passing out of the fluid flow space, thus increasing the possibility for leakage or other failure of the connections and increasing the cost of the system.

As the liquid passes downstream through the channels and is heated by the current passing through it, gas bubbles tend to evolve within the liquid. For example, gases dissolved in the liquid tend to come out of solution as the liquid is heated. If such gas bubbles cling to the sensing wire 76, they can impede heat transfer to the sensing wire and thus cause delayed or erroneous temperature signals. The exit structure and related components minimize the possibility that gas bubbles will cling to the exit wire. The relatively small cross-sectional area of slot 66 tends to create a high-velocity liquid flow through the slot, which aids in stripping bubbles from the wire. Moreover, the collection chambers 70 will tend to catch bubbles present in the liquid so that the bubbles pass out of the channel through the exit ports 72, and thus do not cross the wire at all. Surprisingly, the arrangement of exit ports, collection chambers, and slot tends to provide this action regardless of the orientation of the heater relative to gravity. The precise shape of the collection chambers and associated elements may be varied somewhat. For example, the collection chambers need not be of semicircular shape as shown, but may have a generally polygonal cross-section.

The relatively small cross-sectional areas of the slots and exit bores provide flow resistance which is appreciable in comparison to the flow resistance of the channels 46 and 52. This helps to equalize the velocity of liquid flowing in the various channels.

The modular design of the heater as described herein allows for simple production of heaters having numerous different capacity ranges. A heater with a greater capacity can be provided by simply using longer electrodes, a longer casing 16, and more intermediate elements 32.

In the embodiments discussed above, the different conductances of the different flow paths 46 and 52 are provided by the different spaces between the various electrodes in the wire direction W (FIG. 6). This is desirable, because essentially the entire area of each electrode is exposed to the flowing fluid for transfer of current, and the current densities are substantially uniform over the entire surface area of each electrode. Other, more complicated arrangements could be used to provide the same difference in conductance between the various channels. For example, the channels could be of uniform width in the wire direction, but some channels could have a dielectric barrier extending within the channel in the lateral direction L (FIG. 6) so as to narrow a portion of the conductive path. Alternatively, some of the electrodes could be coated over portions of their surface with a dielectric material so as to reduce the area of the current path and thus increase the electrical resistance of the channel. Such arrangements are less preferred, as they imply non-uniform current densities across the surfaces of the electrodes.

The physical arrangement of the flow channels in two sets—flow channels 46 in the upper flow chamber 42 and flow channels 52 in the lower flow chamber 44—helps to provide a more compact arrangement having a small dimension in the widthwise or wire direction, i.e., in a direction transverse to the upstream and downstream directions. This, in turn, facilitates the construction of the pressurized enclosure, including casing 16. To comply with regulatory and safety requirements, casing 16 typically must be arranged to withstand an internal pressure far above that normally encountered in service.

Heaters as discussed above can be utilized in a variety of applications, but are particularly useful in domestic hot water heating. A single heater may be provided for an entire home or, even more preferably, individual heaters may be associated with individual water-consuming devices or with a subset of the devices in the home as, for example, an individual heater for each bathroom or kitchen. In a system where an individual heater is associated with an individual water-using device such as a faucet or shower, the set point may be set by a knob on the using device.

Although the control system elements, such as the temperature sensing wire, and the bubble-eliminating elements, such as the slot and collection chambers, have been described herein in conjunction with a direct electric resistance heater where the electrical energy application elements of the heater are electrodes, the wire and bubble-eliminating elements can be used in other applications as well. For example, a liquid heater can include multiple channels with individual heating elements exposed to the fluid flowing in each channel, the heating elements being arranged to dissipate electrical power in the heating elements themselves and transfer the heat to the fluid flowing in the individual channels. Such a heater could be equipped with a sensing wire and bubble-eliminating elements as discussed herein.

As these and other variations and combinations of the features discussed above can be utilized without departing from the present invention as defined by the claims, the foregoing description should be taken by way of illustration rather than by limitation of the present invention.

The invention claimed is:

1. A liquid heater comprising a chamber having an inlet and an outlet, and at least three electrodes disposed within said chamber so that the at least three electrodes are in contact with liquid flowing from said inlet to said outlet and wherein the liquid is heated by electrical current flow through the liquid between two or more of the at least three electrodes; an electrical power supply connection; and at least one switch for each of the at least three electrodes, the at least one switch being arranged to removably connect each of the at least three electrodes to the electrical power supply connection independent of the remaining ones of the at least three electrodes, the at least three electrodes being constructed and arranged to provide different current paths through the liquid between different pairs of the at least three electrodes, at least one of the current paths including two of the at least three electrodes connected to the electrical power supply connection and at least one of the at least three electrodes disconnected from the electrical power supply connection and disposed between the two electrodes of the at least three electrodes included in the current path and connected to the electrical power supply connection, different ones of the current paths having different conductances so that connection of different sets of the at least three electrodes to the electrical power supply connection provides different levels of current passing through the liquid, the levels of current including levels defining a stepwise progression between zero current when none of the at least three electrodes are connected and a maximum current when all of the at least three electrodes are connected, the progression having substantially uniform ratios between the currents of adjacent steps with non-zero current levels.

2. A liquid heater as in claim 1 wherein the at least three electrodes define a plurality of adjacent channels for liquid flow from said inlet to said outlet.

3. A liquid heater as in claim 1 wherein the at least three electrodes are non-uniformly spaced apart from one another with different distances between different pairs of mutually-adjacent ones of the at least three electrodes.

4. A liquid heater as in claim 1, wherein a greatest difference between the levels of current in any two adjacent steps of the progression is no greater than 10% of the maximum current.

5. A liquid heater as in claim 1, wherein a greatest ratio between the currents in any two adjacent steps of the progression having non-zero currents is no more than 1.22:1.

6. A liquid heater as in claim 5, wherein the greatest ratio is no more than 1.1:1.

7. A liquid heater as in claim 1, wherein a greatest difference between the levels of current in any two adjacent steps of the progression is no greater than 5% of the maximum current.

8. A liquid heater as in claim 1 wherein said stepwise progression includes at least 60 different current levels.

9. A liquid heater as in claim 1 wherein a ratio between the maximum current and a minimum non-zero current in said progression is at least 250:1.

10. A liquid heater as in claim 1 wherein said electrical power supply connection is a three-phase connection having three terminals and the at least one switch for each of the at least three electrodes is operable to connect each of the at least three electrodes to any one of the terminals of the three-phase connection.

11. A liquid heater as in claim 1 wherein the electrical power supply connection has two opposite terminals and said at least one switch for each of the at least three electrodes is operable to connect each of the at least three electrodes to one or the other terminal of the electrical power supply connection.

12. A liquid heater as in claim 1 further comprising a controller controlling the operation of the at least one switch for each of the at least three electrodes and thereby controlling connection of the at least three electrodes to the electrical power supply connection.

13. A liquid heater as in claim 12 further comprising a temperature sensor sensing the temperature of the liquid after it contacts the at least three electrodes, wherein the controller controls the operation of said at least one switch based upon information received from the temperature sensor.

14. A liquid heater as in claim 13 further comprising an electric current sensor sensing the amount of electric current being utilized by the liquid heater, wherein said controller controls the operation of said at least one switch for each of the at least three electrodes, based upon information received from said electric current sensor.

15. A liquid heater as in claim 13, wherein said controller controls the application of electrical power to the at least three electrodes based upon the temperature sensed by said temperature sensor and the rate of change of the temperature sensed by said temperature sensor.

16. A liquid heater as claimed in claim 13 wherein said controller periodically determines if the combination of the at least three electrodes connected to the electrical power supply connection needs to be changed to raise or lower the current level applied to the liquid, based upon information received from said temperature sensor and a desired liquid temperature at said chamber outlet.

17. A liquid heater as in claim 16 wherein said controller limits the rate of change of electrical current applied to said at least three electrodes, by adjusting the current applied to the at least three electrodes only to a next higher or a next lower current level in the progression, each time said controller periodically determines if there needs to be a change in the current level applied to the liquid.

18. A liquid heater as in claim 17 wherein said controller limits the rate of change of electrical current applied to said at least three electrodes by changing the combination of said at least three electrodes connected to the electrical power supply connection no more than once during every cycle of an alternating current supplied to the electrical power supply connection.

* * * * *